US008351687B1

(12) United States Patent
Bradford et al.

(10) Patent No.: US 8,351,687 B1
(45) **Date of Patent: *Jan. 8, 2013**

(54) BEARING AND EXPANSION JOINT SYSTEM INCLUDING SAME

(75) Inventors: Paul Bradford, West Falls, NY (US); David Kent Fugard, St. Catherines (CA)

(73) Assignee: Watson Bowman Acme Corporation, Amherst, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/330,199

(22) Filed: Dec. 19, 2011

Related U.S. Application Data

(63) Continuation of application No. 11/080,094, filed on Mar. 15, 2005, now Pat. No. 8,091,293, which is a continuation-in-part of application No. 10/949,050, filed on Sep. 24, 2004, now abandoned.

(51) Int. Cl.
*G06K 9/00* (2006.01)
*E01D 19/04* (2006.01)
*E01C 11/00* (2006.01)

(52) U.S. Cl. ..... 382/154; 382/100; 14/73.5; 404/47

(58) Field of Classification Search ..... 382/154, 382/100; 52/1, 167.7, 167.8, 167.9, 399, 52/573.1, 396.06, 393; 404/47, 60, 65, 69, 404/68, 56, 58, 51; 384/36, 37, 42, 907, 384/908, 909; 403/404, 66, 132; 464/183, 464/181; 376/285; 220/665; 14/73.5
See application file for complete search history.

(56) References Cited

U.S. PATENT DOCUMENTS

| | | | | |
|---|---|---|---|---|
| 3,301,609 | A | 1/1967 | Palfreyman | |
| 3,349,418 | A | 10/1967 | Hein | |
| 3,482,492 | A | 12/1969 | Bowman | |
| 3,699,853 | A | 10/1972 | Wicks, III | |
| 3,782,788 | A * | 1/1974 | Koester et al. | 14/73.5 |
| 4,007,994 | A | 2/1977 | Brown | |
| 4,030,156 | A | 6/1977 | Raymond | |
| 4,075,728 | A | 2/1978 | Puccio | |
| 4,076,440 | A | 2/1978 | Bertschmann | |
| 4,080,086 | A | 3/1978 | Watson | |
| 4,087,191 | A | 5/1978 | Brady et al. | |
| 4,111,582 | A | 9/1978 | Tippett | |

(Continued)

FOREIGN PATENT DOCUMENTS

JP 2001-107303 4/2001

OTHER PUBLICATIONS

WABO® Modular Expansion Joint Systems—Brochure (1986).

(Continued)

*Primary Examiner* — Sheela Chawan
(74) *Attorney, Agent, or Firm* — Curatolo Sidoti Co., LPA; Salvatore A. Sidoti; Vincent A. Cortese

(57) ABSTRACT

A bearing is provided for use in connection with expansion joint systems. The bearing may be incorporated into expansion joint systems that are used in roadway constructions, bridge constructions, and architectural structures. The bearing can absorb increased loads that are applied to the expansion joint system. The structure of the bearing also permits improved motion of, and provides improved support for, the components of the expansion joint system that are supported on or engaged with the bearing.

44 Claims, 5 Drawing Sheets

U.S. PATENT DOCUMENTS

| | | | | |
|---|---|---|---|---|
| 4,120,066 | A | 10/1978 | Leroux | |
| 4,163,617 | A * | 8/1979 | Nemoto | 403/132 |
| 4,339,214 | A | 7/1982 | Puccio et al. | |
| 4,516,284 | A | 5/1985 | Huber et al. | |
| 4,533,278 | A | 8/1985 | Corsover et al. | |
| 4,674,912 | A | 6/1987 | Buckenauer | |
| 4,784,516 | A | 11/1988 | Cox | |
| 4,923,328 | A | 5/1990 | Arps et al. | |
| 5,060,439 | A | 10/1991 | Clements et al. | |
| 5,067,297 | A | 11/1991 | Sobol | |
| 5,863,148 | A | 1/1999 | Shivaram | |
| 5,887,308 | A * | 3/1999 | Walter | 14/73.1 |
| 6,039,503 | A | 3/2000 | Cathey | |
| 6,193,199 | B1 * | 2/2001 | Karam, II | 248/276.1 |
| 6,357,328 | B1 * | 3/2002 | Ceroll et al. | 83/477.2 |
| 6,647,083 | B1 * | 11/2003 | Jensen | 376/286 |
| 7,252,454 | B2 | 8/2007 | Bradford et al. | |
| 8,091,293 | B2 | 1/2012 | Bradford | |
| 2006/0067789 | A1 | 3/2006 | Bradford et al. | |
| 2006/0070330 | A1 | 4/2006 | Bradford et al. | |

OTHER PUBLICATIONS

STEELFLEX® Modular Expansion Joint System—Brochure (1996).

TechStar, Inc. Expansion Joints, Modular Joints, Robek System—Brochure.

Maurer Sohne—Swivel Joist Expansion Joint—Brochure (1996).

"bond"; Dictionary.com; Unadbridged (vol. 1.1); Random House, Inc.; Jul. 15, 2009; Dictionary.com http://dictionary.reference.com/browser/bond.

* cited by examiner

BEARING AND EXPANSION JOINT SYSTEM INCLUDING SAME

CROSS REFERENCE TO RELATED APPLICATIONS

This application is a continuation of U.S. Ser. No. 11/080,904, filed on Mar. 15, 2005, now U.S. Pat. No. 8,091,293 B2 which is a continuation-in-part of U.S. Ser. No. 10/949,050, filed on Sep. 24, 2004 now abandoned, both of which are incorporated herein by reference.

BACKGROUND

The present invention relates to a bearing structure. The present invention more particularly relates to a bearing structure for an expansion joint system and an expansion joint system including the bearing structure.

An opening or gap is purposely provided between adjacent concrete structures for accommodating dimensional changes within the gap occurring as expansion and contraction due to temperature changes, shortening and creep of the concrete caused by prestressing, seismic cycling and vibration, deflections caused by live loads, and longitudinal forces caused by vehicular traffic. An expansion joint system is conventionally utilized to accommodate these movements in the vicinity of the gap.

Bridge constructions are especially subject to relative movement in response to occurrence of thermal changes, seismic events, and vehicle loads. This raises particular problems, because the movements occurring during such events are not predictable either with respect to the magnitude of the movements or with respect to the direction of the movements. In many instances, bridges have become unusable for significant periods of time, due to the fact that traffic cannot travel across damaged expansion joints. Gaps or openings in the bridge deck are provided for accommodating these movements, and expansion joint systems are often installed in the gap.

Prior art expansion joint systems include various types of bearings for absorbing loads applied to the expansion joint system and for supporting the various expansion joint system components. However, many of the bearings used in expansion joint systems cannot absorb the increased loads and rotations that are demanded by the roadway and bridge designs. Therefore, a need still exists in the art for an improved bearing structure that can accommodate increased loads and an expansion joint system including an improved bearing that can accommodate movements that occur in the vicinity of a gap having an expansion joint between two adjacent roadway sections, for example, movements that occur in longitudinal and transverse directions relative to the flow of traffic, and which are a result of thermal changes, seismic events, and deflections caused by vehicular loads.

SUMMARY

A bearing structure is provided, said bearing structure comprises a bearing substrate and an upper bearing portion disposed on a portion of said bearing substrate, said upper bearing portion including concavely curved side walls. According to certain embodiments, the upper bearing portion includes curved side walls, a substantially curved upper bearing surface, and a flat seat region.

According to other embodiments, the bearing comprises a bearing substrate having opposite upper and lower surfaces, an upper bearing portion disposed on said upper surface of said bearing substrate, said upper bearing portion including curved side walls, and an open mesh interlocked with said bearing substrate. According to certain embodiments, the upper bearing portion includes curved side walls, a substantially curved upper bearing surface, and a flat seat region.

An expansion joint system is further provided for a roadway construction wherein a gap is defined between adjacent first and second roadway sections, said expansion joint system extending across said gap to permit vehicular traffic, said expansion joint system comprising transversely extending, spaced-apart, vehicular load bearing members, elongated support members having opposite ends positioned below said transversely extending load bearing members and extending longitudinally across said expansion joint gap, first means for accepting ends of said longitudinally extending elongated support members for controlling the movement of said ends of said support members within said first means for accepting longitudinally extending elongated support members, second means for accepting opposite ends of said longitudinally extending elongated support members for controlling the movement of said opposite ends of said support members within said second means for accepting longitudinally extending elongated support members, and bearing means disposed between said ends of said longitudinally extending elongated support members and said first and second means for accepting ends of said longitudinally extending elongated support members, said bearing means comprising a bearing substrate and an upper bearing portion disposed on said bearing substrate, said upper bearing portion including concavely curved side walls. According to certain embodiments, the bearing includes an upper bearing portion having curved side walls, a substantially curved upper bearing surface, and a flat seat region.

In another embodiment, an expansion joint system is provided for a roadway construction wherein a gap is defined between adjacent first and second roadway sections, said expansion joint system extending across said gap to permit vehicular traffic, said expansion joint system comprising transversely extending, spaced-apart, vehicular load bearing members, elongated support members having opposite ends positioned below said transversely extending load bearing members and extending longitudinally across said expansion joint, means for movably engaging said longitudinally extending, elongated support members with at least one of said transversely extending, spaced-apart load bearing members, and bearing means disposed between lateral sides of said longitudinally extending elongated support members and surfaces of said means for movably engaging at least one of said longitudinally extending, elongated support members with said transversely extending, spaced-apart load bearing members, said bearing means comprising a bearing substrate and an upper bearing portion disposed on said bearing substrate, said upper bearing portion including concavely curved side walls. According to certain embodiments, the bearing includes an upper bearing portion having curved side walls, a substantially curved upper bearing surface, and a flat seat region.

According to further embodiments, an expansion joint system is provided for roadway construction wherein a gap is defined between adjacent first and second roadway sections, said expansion joint system extending across said gap to permit vehicular traffic, said expansion joint system comprising: transversely extending, spaced-apart, vehicular load bearing members, at least one elongated support member having opposite ends positioned below said transversely extending load bearing members and extending longitudinally across said expansion joint, first means for accepting ends of said longitudinally extending elongated support members for controlling the movement of said ends of said support members within said first means for accepting longitudinally extending elongated support members, second means for accepting opposite ends of said longitudinally extending elongated support members for controlling the movement of said opposite ends of said support members within said second means for accepting longitudinally extending elongated support members, and bearing means disposed between surfaces of said longitudinally extending elongated support members and inner surfaces of at least one of said first and second means for accepting ends of said longitudinally extending elongated support members, said bearing means comprising a bearing substrate having opposite upper and lower surfaces, an upper bearing portion disposed on said upper surface of said bearing substrate, said upper bearing portion including curved side walls, and an open mesh interlocked with said bearing substrate. According to certain embodiments, the bearing includes an upper bearing portion having curved side walls, a substantially curved upper bearing surface, and a flat seat region.

According to further embodiments, an expansion joint system is provided for roadway construction wherein a gap is defined between adjacent first and second roadway sections, said expansion joint system extending across said gap to permit vehicular traffic, said expansion joint system comprising transversely extending, spaced-apart, vehicular load bearing members, elongated support members having opposite ends positioned below said transversely extending load bearing members and extending longitudinally across said expansion joint, means for movably engaging said longitudinally extending, elongated support members with at least one of said transversely extending, spaced-apart load bearing members; and bearing means disposed between surfaces of said longitudinally extending elongated support members and surfaces of said means for movably engaging at least one of said longitudinally extending, elongated support members with said transversely extending, spaced-apart load bearing members, said bearing means comprising a bearing substrate having opposite upper and lower surfaces, an upper bearing portion disposed on said upper surface of said bearing substrate, said upper bearing portion including curved side walls, and an open mesh interlocked with said bearing substrate.

A composite sliding material is also provided. The composite sliding material comprises a substrate interlocked with a friction-reducing element, wherein said composite sliding material includes a continuous sliding surface.

DETAILED DESCRIPTION

Figure 1:
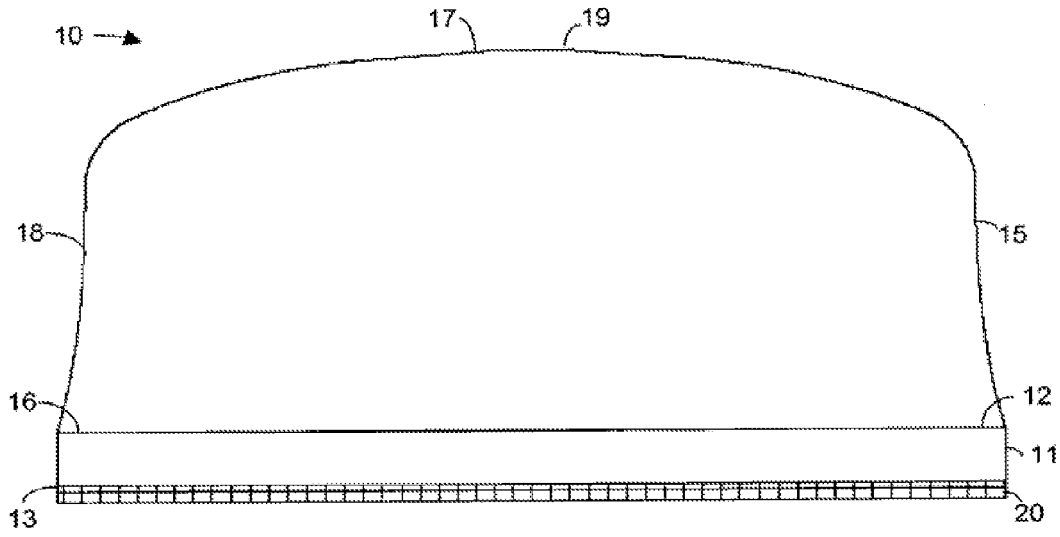
FIG. 1 is a side view of one embodiment of the bearing in an uncompressed state in the absence of a load (i.e.—an unloaded state).

An improved bearing structure is provided. Without limitation, the bearing can be utilized in connection with an expansion joint system in roadway constructions, bridge constructions, tunnel constructions, and other constructions where gaps are formed between spaced-apart, adjacent concrete sections. The expansion joint system may be utilized where it is desirable to absorb loads applied to the expansion joint system, and to accommodate movements that occur in the vicinity of the expansion joint gap in response to the application of loads to the expansion joint system.

The bearing structure includes a bearing substrate and an upper bearing portion that is disposed on the bearing substrate. The upper bearing portion of the bearing structure includes curved side walls, a curved upper bearing surface, and a flat seat region. According to one embodiment, the bearing structure includes polytetrafluoroethylene layer bonded to the lower surface of the bearing substrate.

According to certain embodiments, the bearing comprises a bearing substrate having opposite upper and lower surfaces. An upper bearing portion is disposed on the upper surface of the bearing substrate. The upper bearing portion has a lower surface, an upper bearing surface, and side walls that extend between the lower surface and the upper bearing surface. The side walls of the upper bearing portion are concavely curved toward the center of the upper bearing portion. According to certain embodiments, the upper bearing portion includes concavely curved side walls, a curved upper bearing surface, and a flat seat region. An open mesh is interlocked with the bearing substrate. The open mesh may be partially embedded in the lower surface of the bearing substrate to create the positive interlock between the bearing substrate and the open mesh material.

The bearing substrate and upper bearing portion of the bearing structure may be manufactured from materials having different material hardness properties or "durometers." Thus, according to certain embodiments, the bearing substrate may be manufactured from a material having a first durometer and the upper bearing portion may be manufactured from a material having a second durometer, which is different from the first durometer. By using materials having different durometers, a so-called "dual durometer" bearing structure can be prepared.

Suitable materials from which the bearing substrate may be manufactured include polymeric materials and fiber reinforced polymer composite materials. Without limitation, suitable polymeric materials from which the bearing substrate may be manufactured include polyurethane, polytetrafluoroethylene, a polyalkylene, nylon, and the like. According to certain embodiments, the lower bearing substrate is manufactured from a resilient polyurethane material.

The upper bearing portion of the bearing structure comprises a natural or synthetic elastomeric material that is capable of undergoing a conformational change in response to the application of a load to said bearing. Suitable elastomeric materials from which the upper bearing portion of the bearing structure may be manufactured include polyurethane, polychloroprene, isoprene, styrene butadiene rubber, natural rubber, and the like. According to certain embodiments, the upper bearing portion of the bearing structure is manufactured from a polyurethane material which is capable of undergoing a conformational change in response to the application of a load to the bearing structure. Because the upper bearing portion of the bearing structure is manufactured from a material having elastomeric properties, the upper bearing portion is capable of returning to its original shape upon cessastion of the application of a force or load to the bearing structure.

According to certain embodiments, the bearing structure includes a bearing substrate comprising a resilient polyurethane material having a first durometer and an upper bearing portion comprising an elastomeric polyurethane material having a second durometer.

The bearing structure includes an open mesh or netting material that is interlocked with the bearing substrate. According to certain embodiments, the open mesh that is interlocked with the bearing substrate is a non-metal mesh. Preferably, the open, non-metal mesh that is interlocked with the bearing substrate is a polymeric mesh. Without limitation, suitable a polymeric mesh may include polytetrafluoroethylene meshes, polyalkylene meshes, nylon meshes, and other polymeric meshes having similar properties.

According to certain embodiments, the polymeric mesh that is interlocked with the bearing substrate of the bearing structure is a polytetrafluoroethylene mesh. A suitable polytetrafluoroethylene mesh that can be interlocked with the bearing substrate is an open mesh of diamond-shaped apertures having a thickness of about 0.075 inches. The aperture size is approximately 0.126 inches (long axis) by 0.052 inches (short axis) and the strands of the open mesh have a width of about 0.055 inches. The polytetrafluoroethylene mesh exhibits a high degree of chemical resistance, is non-toxic, and exhibit low friction characteristics.

The open mesh material is placed into the bottom of a suitably shaped mold. The bearing substrate material is poured over the open mesh and is permitted to flow into the apertures of the open mesh. As the bearing substrate material hardens, a positive interlock is formed between the open mesh and the bearing substrate. The open mesh may be coextensive with the outer periphery of the bearing substrate. The upper bearing portion material is then introduced into the mold and is poured over the top surface of the hardened bearing substrate. As the upper bearing portion material hardens it forms bond between the lower surface of the upper bearing portion and the upper surface of the bearing substrate.

According to further embodiments, a composite sliding material is provided. The composite sliding material may be incorporated into an expansion joint system for roadway and bridge constructions. The composite sliding material comprises a substrate interlocked with a low friction material element. Interlocking the substrate with the low friction material element provides a composite sliding material with a contiguous sliding surface. Without limitation, the composite sliding material may be incorporated into a wide variety of bearing structures as a component of an expansion joint system for roadway and bridge constructions. For example, without limitation, the composite sliding material may be incorporated into a bearing for use in an expansion joint system. There is no limitation on the type or structure of bearing which may incorporate the composite sliding material.

According to certain embodiments, the composite sliding material comprises a polymeric mesh material in combination with a polymeric substrate. According to this embodiment, at least a portion of the polymeric substrate provides a means to interlock the polymeric mesh to the polymeric substrate. The interlocking of the mesh material to the polymeric substrate provides a composite material having a contiguous sliding surface. In one embodiment, the composite sliding material includes a polyurethane substrate material that is interlocked with a polytetrafluoroethylene mesh material.

Without limitation, the composite sliding material may be manufactured by molding the polyurethane substrate into polytetrafluoroethylene mesh material such that a portion of said polyurethane substrate provides means to interlock the polytetrafluoroethylene mesh. Together, the polytetrafluoroethylene mesh and polyurethane substrate form one continuous sliding surface.

According to other embodiments, the composite sliding material may include a substrate in combination with an asymmetric apertured layer. According to this embodiment, it is to utilize a plastic sheet layer having a plurality of randomly oriented apertures. According to this embodiment, at least a portion of the polymeric substrate provides a means to interlock the polymeric mesh to the apertured sheet layer. The interlocking of the apertured layer to the polymeric substrate provides a composite material having a contiguous sliding surface. Without limitation, the composite sliding material may be manufactured by molding a polyurethane substrate material, such as polyurethane, into the apertured layer such that a portion of said polyurethane substrate provides means to interlock the apertured layer. Together, the apertured layer and the polyurethane substrate form one continuous sliding surface.

An illustrative embodiment of the bearing structure will now be described in greater detail with reference to the FIGURES. It should be noted that the bearing structure is not intended to be limited to the illustrative embodiments shown in the FIGURES, but shall include all variations and modifications within the scope of the claims.

FIG. 1 shows a side view of one embodiment of the bearing structure 10 in a compressed (unloaded) state. Bearing structure 10 comprises a bearing substrate 11 that is manufactured from a resilient material having a first durometer. According to the embodiment shown in FIG. 1, bearing substrate 11 is shown having a substantially cylindrical shape. The bearing substrate 11 includes an upper surface 12, a lower surface 13, and side walls 14 which extend between upper surface 12 and lower surface 13.

Bearing structure 10 also includes an upper bearing portion 15. Upper bearing portion 15 includes a lower surface 16, an upper bearing surface 17, and side walls 18. Upper bearing portion 15 is disposed on bearing substrate 11 in a manner that at least a portion of lower surface 16 of upper bearing portion 15 is bonded to upper surface 12 of bearing substrate 11. The upper bearing surface 17 of the upper bearing portion 15 may include a centrally located flat seat region 19.

An open mesh 20 is interlocked with lower surface 13 of bearing substrate 11 of bearing 10. According to certain embodiments, open mesh 20 is partially embedded in the bearing substrate 11. Without limitation, it is possible to create the positive interlock between the open mesh 20 and the bearing substrate 11 by partially embedding the open mesh 20 in lower surface 12 of the bearing substrate 11.

According to FIG. 1, the bearing structure 10 is shown under conditions where no force or load is applied to the upper bearing surface 17 of the upper bearing portion 15 of the bearing 10. In the uncompressed state, the side walls 18 of the upper bearing portion 15 are constructed such that in the absence of a force or load on the upper bearing portion 15 the side walls 18 of upper bearing portion 15 have a curved shape. According to certain embodiments, in an uncompressed state in the absence of a load applied to the bearing 10, the side walls 18 of upper bearing portion 15 remain concavely curved and "bow in" toward the center of the upper bearing portion 15 of the bearing 10.

Figure 2:
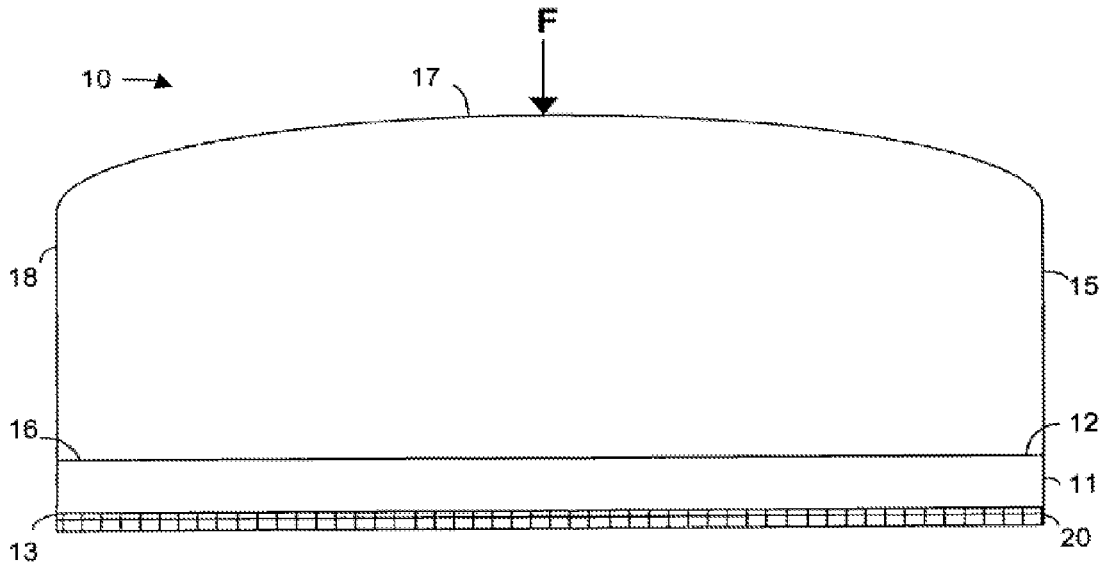
FIG. 2 is a side view of one embodiment of the bearing in a compressed state in response to the application of a load (F) to the bearing (i.e.—a loaded state).

Turning to FIG. 2, the bearing structure 10 is shown under conditions where a force or load (F) is applied to the upper bearing surface 17 of the upper bearing portion 15. Under conditions where a force or load is applied to the upper bearing surface 17 of the bearing 10, the side walls 18 of upper bearing portion 15 are urged outwardly toward the outer circumference of the bearing 10, while the upper bearing surface 17 of the upper bearing portion 16 moves into closer proximity with bearing substrate 11. As upper bearing portion 15 is compressed in a downward direction toward bearing substrate 11, the shape of the side walls 18 of upper bearing portion 15 undergo a transition from being concavely curved toward the center of the upper bearing portion 15 to a vertical configuration. That is, as upper bearing portion 15 is compressed downwardly, the side walls 18 change configuration from the concavely shaped side walls to a position that is perpendicular to the upper bearing surface 17 of upper bearing portion 15 and upper surface 12 of bearing substrate 11. When an out of level force or load is applied to upper bearing surface 17 at an angle, the upper bearing portion 15 of structural bearing 10 is able to transmit the vertical load such that the bottom surface of the bearing "feels" very minimal eccentricity.

Distortional stresses in response to the application of a load to a traditional bearing structure often caused damage to the bearing structure. The use of the bearing structure 10 having concavely curved side walls 18 minimizes the distortional stresses below the bearing surface in response to the application of a force or load. The optimized geometric combination of curved side walls, curved upper bearing surface, and flat seat region reduces local distortional stresses directly below the applied load, and moves the maximum distortional stress region to below the surface, based on the accepted principles of elasticity.

It is known that prior art bearing structure stiffness remains nearly constant over the range of applications, as they are compressed in response to the application of a load to the bearing. The use of the bearing structure 10 having an upper bearing portion 15 with concavely curved side walls 18 provides an increasing force versus deflection spring rate. Utilizing the bearing structure 10 having an upper bearing portion 15 with curved side walls 18 permits the bearing structure to be precompressed to a significant degree, thereby mitigating bearing vibration when large vehicular impact loads are applied to the bearing. Additionally, the use of the bearing structure 10 having an upper bearing portion 15 with curved side walls 18 stabilizes large displacements in response to loads applied to the bearing 10.

In general, the top bearing surfaces of prior art bearings expand and contract against the support bar of the expansion joint systems in response to an application of a load, which causes significant rubbing and friction between the top bearing surfaces of the bearings and the surfaces of the support bar of the expansion joint systems. In contrast, upper bearing portion 15 of the bearing structure 10 expands upward to contact the surface of the support bar of the expansion joint systems. Under these conditions, less surface rubbing and friction occur between the upper bearing surface 17 and the surface of the support bars of the expansion joint system. Because there is less friction between the top bearing surface 17 of the bearing 10 and the surfaces of the support bars, there is a significant decrease in the surface wear of the bearing 10. Thus, the overall life of the bearing is increased.

The side walls of the prior art bearings bulge outwardly upon an application of a load to the top bearing surface. These bearings, sometimes referred to as parabolic bulge bearings, are bonded on the top and bottom surfaces, and are free to bulge on their sides. These bearings produce very large surface shears at the point where the free edge of the bearing meets the bonded surfaces. In contrast to prior art parabolic bulge bearings, the side walls 18 of bearing 10 are constructed in such a manner that upon maximum compression by a load applied to the bearing, the side walls 18 of upper bearing portion 15 are vertical. This is a significant improvement over prior art parabolic bulge bearings, as shear strains at the point of the bond of the free edge to the bonded edge is minimized.

An expansion joint system incorporating the improved structural bearing 10 is further provided. The expansion joint system may be utilized in a roadway construction wherein a gap is defined between adjacent first and second roadway sections. The expansion joint system extends across the gap between adjacent concrete roadway sections to permit vehicular traffic. The expansion joint system comprises transversely extending, spaced-apart, vehicular load bearing members. Elongated support members having opposite ends are positioned below the transversely extending load bearing members and extend longitudinally across the gap in the expansion joint from a first concrete roadway section to a second concrete roadway section. According to certain embodiments, the expansion joint system also includes first means for accepting first ends of the longitudinally extending elongated support members for controlling the movement of the ends of the support members within the first means for accepting longitudinally extending elongated support members, and second means for accepting opposite ends of the longitudinally extending elongated support members for controlling the movement of the opposite ends of said support members within the second means for accepting longitudinally extending elongated support members. Bearing structures 10 are disposed between surfaces of the opposite first and second ends of the longitudinally extending elongated support members and inner surfaces of the first and second means for accepting ends of the longitudinally extending elongated support members to absorb loads applied to the expansion joint system. The bearing structure includes a substrate and an upper bearing portion that is disposed on, or otherwise bonded over, the substrate. The upper bearing portion of the bearing comprises curved side walls and a curved upper bearing surface.

According to certain embodiments, the bearing structure that is incorporated into the expansion joint system includes a bearing substrate having opposite upper and lower surfaces, an upper bearing portion that is disposed on the upper surface of the bearing substrate, and an open mesh that is interlocked with the bearing substrate. The upper bearing portion of the bearing structure may comprise curved side walls, a curved upper bearing surface, and a centrally located seat region.

According to other embodiments, the expansion joint system includes transversely extending, spaced-apart, vehicular load bearing members, elongated support members having opposite ends positioned below the transversely extending load bearing members and extending longitudinally across the expansion joint, and means for movably engaging the longitudinally extending, elongated support members with the transversely extending, spaced-apart load bearing members. Bearings 10 are disposed between surfaces of lateral sides of the longitudinally extending elongated support bar members and surfaces of the means for movably engaging the longitudinally extending, elongated support bar members with the transversely extending, spaced-apart load bearing members. The bearing structure 10 includes a substrate and an upper bearing portion that is disposed on, or otherwise bonded over, the substrate. The upper bearing portion of the bearing comprises curved side walls, a curved upper bearing surface, and a centrally disposed flat seat region.

Figure 3:
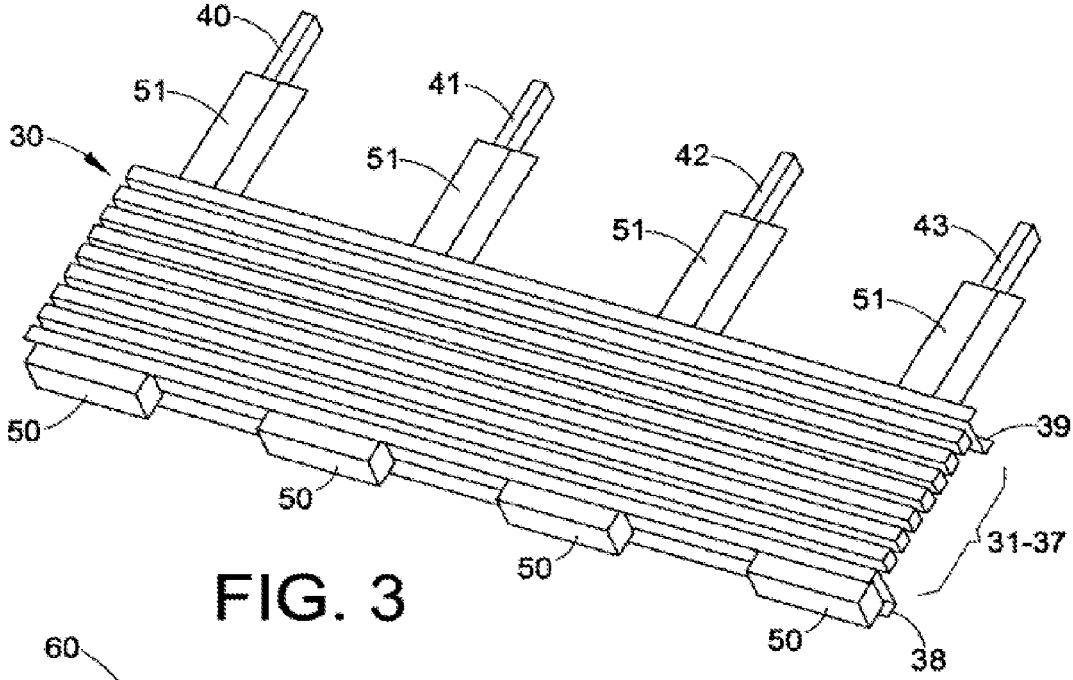
FIG. 3 shows a top perspective view of the expansion joint system including the bearing structure

Now referring to illustrative FIG. 3, an illustrative modular expansion joint system 30 is shown. Expansion joint system 20 includes a plurality of vehicular load bearing members 31-37. The vehicular load bearing members 31-37 of expansion joint system 30 are adapted to be positioned in the gap between the adjacent roadway sections (not shown). The vehicle load bearing members 31-37 are often referred to in the art as "center beams." While illustrative FIG. 3 shows seven transversely extending load bearing members 31-37, it should be noted that the expansion joint system 30 may include any number of transversely extending load bearing members, depending on the size of the gap of the particular construction. According to certain embodiments, the load bearing members have a generally square or rectangular cross section. Nevertheless, the load bearing members 31-37 are not limited to members having approximately square or rectangular cross sections, but, rather, the load bearing beam members 31-37 may comprise any number of cross sectional configurations or shapes. The shape of the cross section of load bearing beam members 31-37 is only limited in that the load bearing beams 31-37 must be capable of permitting relatively smooth and unimpeded vehicular traffic across the top surfaces of the load bearing beam members, and the load bearing beam members must have the ability to support engaging means that are engaged to the bottom surfaces of the load bearing beam members to engage the longitudinally extending elongated support members. According to certain embodiments, the top surfaces of the load bearing beam members may, for example, also be contoured to facilitate the removal of debris and liquids, such as rainwater runoff.

The load bearing beam members 31-37 are positioned in a spaced apart, side-by-side relationship and extend transversely in the expansion joint gap relative to the direction of vehicle travel. That is, the load bearing members 31-37 extend substantially perpendicular, relative to the direction of vehicle travel across the expansion joint system 30. The top surfaces of the load bearing beam members are adapted to support vehicle tires as a vehicle passes over the expansion joint. Compressible seals may be placed and extend transversely between the positioned vehicular load bearing beam members 31-37 adjacent the top surfaces of the beam members 31-37 to fill the spaces between the beam members 31-37. The seals may also be placed and extend in the space between end beam member 31 and edge plate 38 and to extend between end beam member 37 and edge plate 39. The seals may be flexible and compressible and, therefore, may stretch and contract in response to movement of the load bearing beams within the expansion joint. The seals are preferably made from a durable and abrasion resistant elastomeric material. The seal members are not limited to any particular type of seal. Suitable sealing members that can be used include, but are not limited to, strip seals, glandular seals, and membrane seals.

Still referring to FIG. 3, the expansion joint system 30 includes elongated support bar members 40-43. Support bar members 40-43 are positioned in a spaced-apart, side-by-side relationship and extend longitudinally across the gap of the expansion joint, relative to the direction of the flow of vehicular traffic. That is, the support bar members 40-43 extend substantially parallel relative to the direction of vehicle travel across the expansion joint system 30. The support bar members 40-43 provide support to the vehicle load bearing beams 31-37 as vehicular traffic passes over the expansion joint system 30. Support bar members 40-43 also accommodate transverse, longitudinal and vertical movement of the expansion joint system 30 within the gap.

Opposite ends of the support bar members 40-43 are received into suitable means for accepting the ends of the support bar members 40-43, and the several means for accepting the support bar members are disposed, or embedded in portions of respective adjacent roadway sections in the roadway construction. The expansion joint system 30 can be affixed within the "block-out" areas between two adjacent roadway sections by disposing the system 30 into the gap between the roadway sections and pouring concrete into the block-out portions or by mechanically affixing the expansion joint system 30 in the gap to underlying structural support. Mechanical attachment may be accomplished, for example, by bolting or welding the expansion joint system 30 to the underlying structural support.

In accordance with the invention, provision is made for particular types of movement of the support bar members 40-43 within the separate means for accepting the ends of the support bar members. In one embodiment, the means for accepting the ends of the support bar members comprise box-like structures. It should be noted, however, that the means for accepting the ends of the support bar members may include any structure such as, for example, receptacles, chambers, housings, containers, enclosures, channels, tracks, slots, grooves or passages, that includes a suitable cavity for accepting opposite end portions of the support bar members 40-43.

Still referring to FIG. 3, the expansion joint system 30 includes first means 50 for confining the first ends of the support bars 40-43 against longitudinal movement within the first means 50 for accepting, but permitting transverse movement of the first ends of the support bar members 40-43 within the first means 50 for accepting. Therefore, the expansion joint system 30 includes first means for accepting first ends of the longitudinally extending elongated support members which substantially restricts longitudinal movement within the first means for accepting, but permits transverse and vertical movement within said first means for accepting.

The expansion joint system 30 includes second means 51 for accepting opposite ends of the support members 40-43 for confining the opposite ends of the support bars 40-43 against transverse movement within the second means 51 for accepting, but permitting longitudinal movement and vertical movement within the second means 51 for accepting. Therefore, the expansion joint system 30 includes second means for accepting ends of said longitudinally extending elongated support members which substantially restricts transverse movement within said second means for accepting, but permits longitudinal movement within said second means for accepting.

Figure 4:
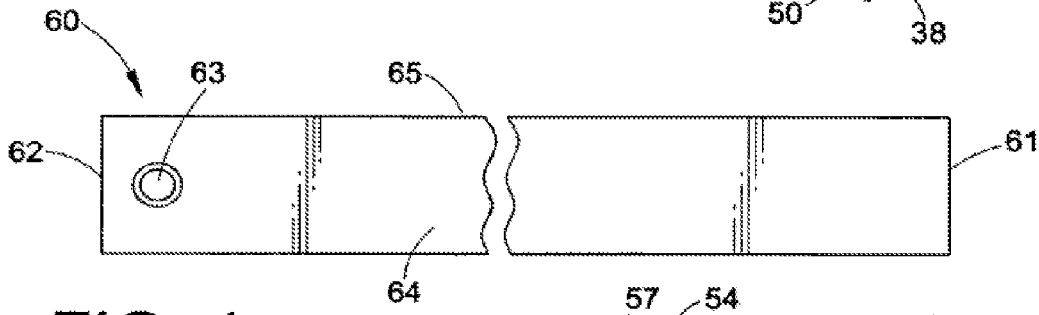
FIG. 4 is a side view of an illustrative support bar member.

FIG. 4 shows an illustrative support member 60 of the expansion joint system 30, which is similar to the support bar members 40-43 shown in FIG. 3. The support member 60 is shown as an elongated bar-like member having a square cross section. It should be noted, however, that the support member 60 is not limited to elongated bar members having square cross sections, but, rather, the support member 60 may comprise an elongated bar member having a number of different cross sectional shapes such as, for example, round, oval, oblong and rectangular. The support bar 60 includes opposite ends 61, 62. Illustrative support bar 60 includes a hole 63 communicating from one side 64 of the support bar 60 to the other side 65. According to this embodiment, the hole 63 is adapted to receive a securing means. End 62 of the support bar 60 having the hole 63 therein is adapted to be inserted into first means 50 for permitting transverse and vertical movement, but substantially restricting longitudinal movement of the support member 60 of the expansion joint system 30 within the means 50. End 61 of support bar member 60 is adapted to be inserted into means 51.

Figure 5:
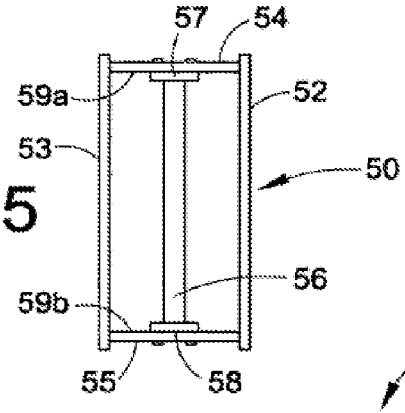
FIG. 5 is a rear view of the means for permitting transverse movement of the support bar members.

FIG. 5 shows a side view of means 50, which according to the embodiment shown is a substantially rectangular box structure, and which permits transverse and vertical movement of support bars 40-43 of the expansion joint system 30 in response to movement within the expansion joint. The transverse and vertical movement box 50 includes top 52 and bottom 53 plates, side plates 54, 55 and back plate (removed). According to this embodiment, the securing means 56 is an elongated, substantially cylindrical guide rod to which a support bar 40-43 is engaged. The securing means 56 is substantially centrally disposed within box 50 and extends across box 50 from side plate 54 to side plate 55. The securing means 56 may be held in place by holding plates 57, 58, which are attached to the inside wall surfaces 59*a*, 59*b* of side plate 54 and side plate 55, respectively. The securing means 56 is inserted into the hole 63 in order to secure the support bar 60 within means 50. The securement means 56 can be any means which permits pivotable movement of end 62 of the support bar in the vertical direction within means 50, while further permitting transverse movement of end 62 of the support bar along the axis of the securement means. Thus, the securing means 56 substantially restricts longitudinal movement of the support bar 60, but permits transverse and vertical movement. While the securing means 56 is shown in FIG. 5 as a cylindrical guide rod, it may, for example, include differently shaped rods, bars, pegs, pins, bolts, and the like.

Figure 6:
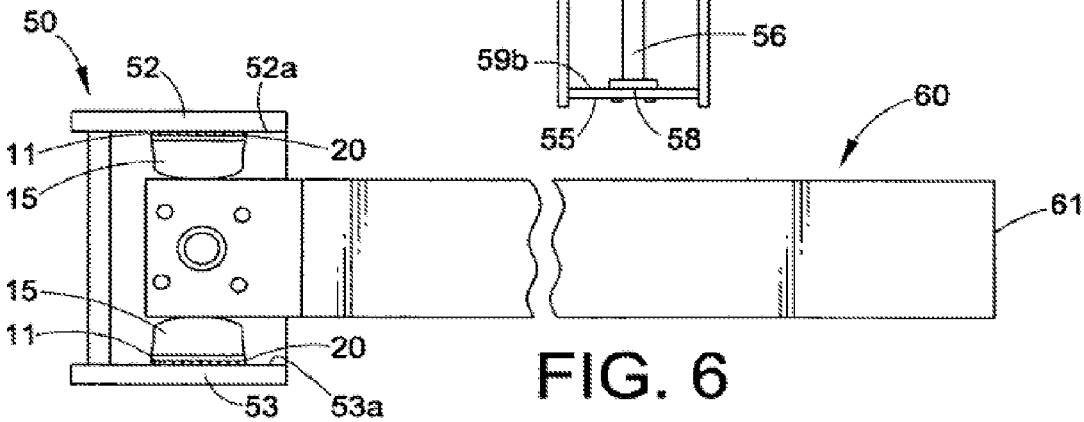
FIG. 6 is a side view of an illustrative support bar member inserted into means for permitting transverse movement of the support bar member.

FIG. 6 shows one end 62 of the support bar 60 inserted into means 50. Bearing means 10 are disposed between the top surface of support bar member 60 and the inner surface 52*a* of top plate 52 of box 50 and between the bottom surface of the support bar member 60 and the inner surface 53*a* of bottom plate 53. The rigid bearing substrate 11 of bearing structure is positioned adjacent to inside surface 52*a* of top plate 52 and upper bearing surface 17 of upper bearing portion 15 may contact top surface of support bar member 60. A second bearing means 10 is positioned within box 50. The rigid bearing substrate 11 of the second bearing structure is positioned adjacent to inside surface 53*a* of bottom plate 53 and upper bearing surface 17 of upper bearing portion 15 may contact bottom surface 64 of support bar member 60.

Figure 7A:
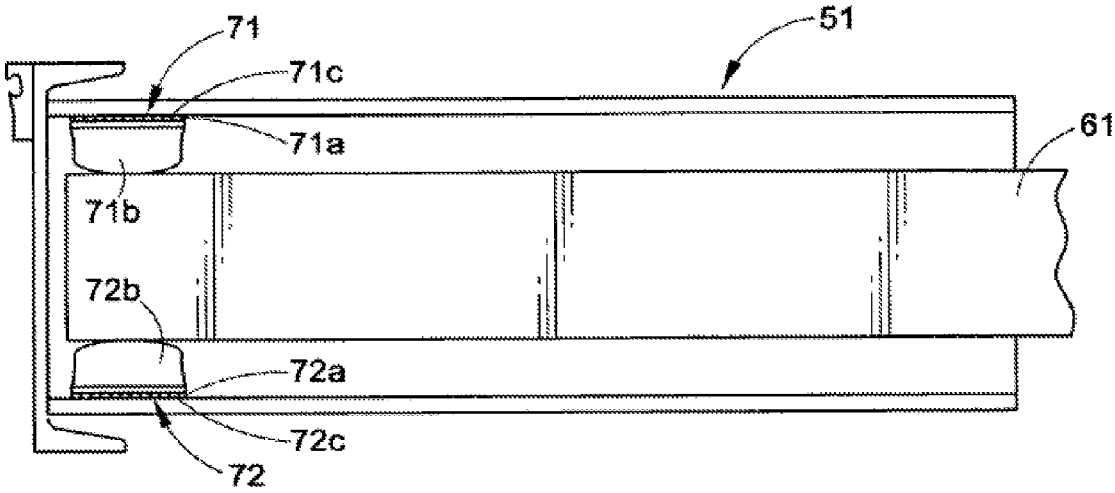
FIG. 7A is a side view of the means for permitting longitudinal and vertical movement of the support bar member.
Figure 7B:
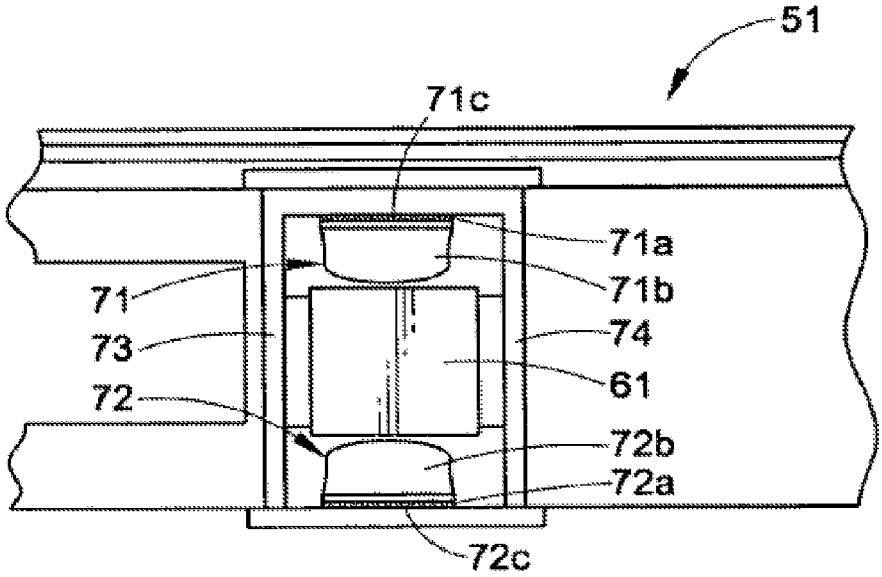
FIG. 7B is an end view of the means for permitting longitudinal and vertical movement of the support bar member.

FIGS. 7A and 7B shows longitudinal movement support box 51. Box 51 includes means for permitting longitudinal and vertical movement of the support bars 40-43 of FIG. 3 within box 51, and means for substantially preventing transverse movement of support bars 40-43 within the box 51. Preferably, the upper 71 and lower 72 bearing means maintain the vertical load on the support bars perpendicular to the axis of the support bars and, permits slidable movement of the support bars in the direction of vehicular traffic flow (longitudinal movement). Upper and lower bearing means 71, 72 are the constructed like bearing structure 10 described in FIGS. 1-2. Bearing 71 includes bearing substrate 71*a*, upper bearing portion 71*b* bonded to bearing substrate 71*a*, and open mesh 71*c* interlocked with bearing substrate 71*a*. Likewise, Bearing 72 includes bearing substrate 72*a*, upper bearing portion 72*b* bonded to bearing substrate 72*a*, and open mesh 72*c* interlocked with bearing substrate 72*a*. As shown in FIG. 7B, side bearing means 73, 74 substantially prevent transverse movement of support bar 60 within box 51, while not inhibiting or otherwise preventing longitudinal and vertical movement. According to the embodiment shown, side bearing means 73, 74 are provided in the form of bearing plates that are disposed adjacent the inner surfaces of box 51. The use of the upper 71 and lower 72 bearings maintain the vertical load on the bearings perpendicular to the sliding surfaces. The upper and lower bearings are capable of absorbing impact from vehicular traffic moving across the expansion joint system.

The transverse movement box for receiving one end of the support bars is designed to permit transverse and vertical movement of the support bars within the boxes in response to changes in temperature changes, seismic movement or deflections caused by vehicular traffic, while restricting longitudinal movement. Longitudinal boxes for receiving the opposite ends of the support bars are designed to permit relative longitudinal and vertical movement of the support bar within the boxes, while confining the bars against relative transverse movement.

Figure 8A:
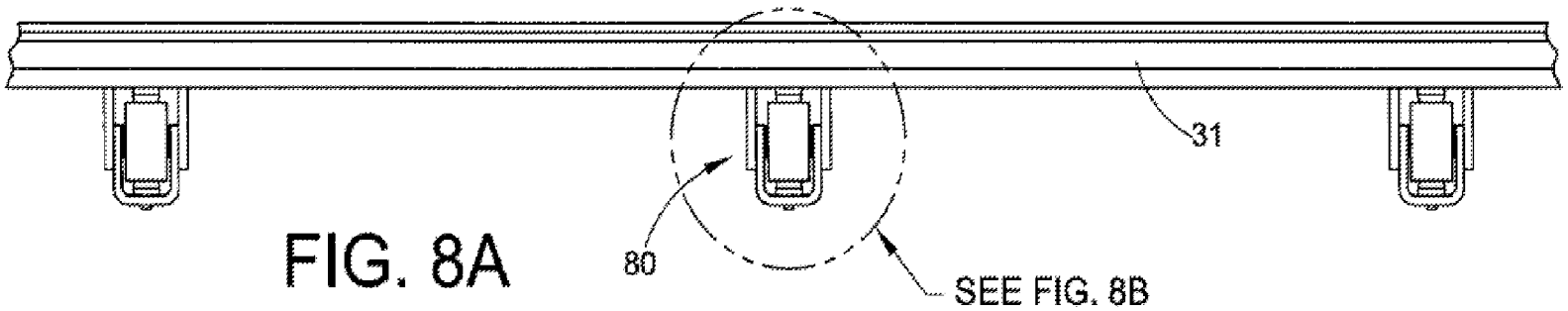
FIG. 8A is a side view of a portion of the expansion joint system including an end view of the yoke assembly for maintaining the support bar member in proximity to the bottom surfaces of the load bearing beams of the expansion joint system.
Figure 8B:
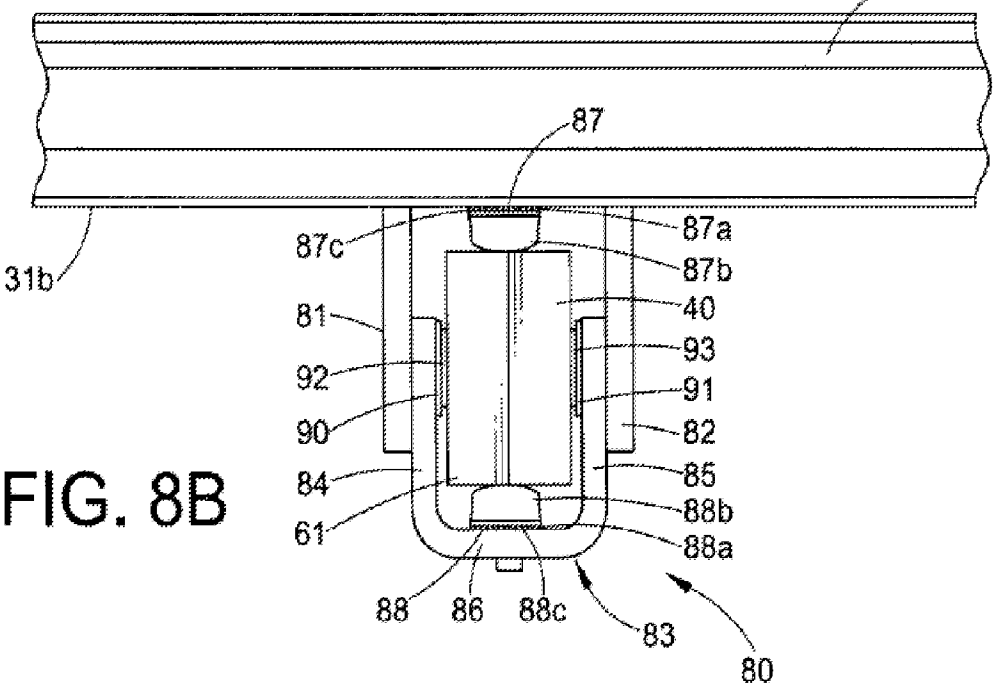
FIG. 8B is an enlarged fragmentary side view of a portion of the expansion joint system including an end view of the yoke assembly for maintaining the support bar member in proximity to the bottom surfaces of the load bearing beams of the expansion joint system.

Means are provided to maintain the position of support bars 40-43 relative to the bottom surfaces of the load bearing beams members 31-37. Also, the means permit longitudinal and limited vertical movement of the support bars 40-43 within the means. FIGS. 8A and 8B show one embodiment of the means, which comprises a yoke or stirrup assembly 80 for retaining the position of the support bars 40-43 relative to the bottom surfaces of the load bearing beams 31-37 of the expansion joint system 30. As shown in FIG. 8B, the yoke assembly 80 includes spaced-apart yoke side plates 81, 82 that are attached to and extend away from the bottom surface of the vehicular load bearing beam 31. Bent yoke plate 83 includes leg portions 84, 85 and spanning portion 86 that extends between legs 84, 85. The yoke assembly 80 also includes upper yoke bearing 87 and lower yoke bearing 88. The yoke assembly 80 utilizes upper 87 and lower 88 yoke bearings to minimize yoke tilt and optimizes the ability of the expansion joint system 30 to absorb vehicular impact from traffic moving across the expansion joint system 30. Upper and lower yoke bearing means 87, 88 are the constructed like bearing structure 10 described in FIGS. 1-2. Bearing 87 includes bearing substrate 87*a*, upper bearing portion 87*b* bonded to bearing substrate 87*a*, and open mesh 87*c* interlocked with bearing substrate 87*a*. Likewise, Bearing 88 includes bearing substrate 88*a*, upper bearing portion 88*b* bonded to bearing substrate 88*a*, and open mesh 88*c* interlocked with bearing substrate 88*a*.

While the one embodiment is shown utilizing a yoke or stirrup assembly to maintain the positioning of the support bars 40-43, any restraining device or the like that can maintain the position of the support bars 40-43 relative to the load bearing beams 31-37 may be utilized.

Yoke assembly 80 may further include yoke retaining rings 90, 91 and yoke discs 92, 93, which are located on the inner surfaces of bent yoke legs 74, 75. The yoke retaining rings 81, 82 and yoke discs 83, 84 are provided to allow limited vertical and longitudinal movement of the support bars 40-43. Furthermore, the yoke side plates 81, 82 are spaced apart at a distance sufficient to permit bent yoke plate 83 to be inserted in the space defined by the inner surfaces of yoke side plates 81, 82.

The expansion joint system 30 may also include means for controlling the spacing between the transversely extending load bearing beam members 31-37 in response to movement in the vicinity of the expansion joint. In one embodiment, the means for controlling the spacing between beam members 31-37 maintains a substantially equal distance between the spaced-apart, traffic load bearing beams 31-37 that are transversely positioned within the gap in an expansion joint, in response to movements caused by thermal or seismic cycling and vehicle deflections.

The expansion joint system of the invention is used in the gap between adjacent concrete roadway sections. The concrete is typically poured into the blockout portions of adjacent roadway sections. The gap is provided between first and second roadway sections to accommodate expansion and contraction due to thermal fluctuations and seismic cycling. The expansion joint system can be affixed within the block-out portions between two roadway sections by disposing the system into the gap between the roadway sections and pouring concrete into the block-out portions or by mechanically affixing the expansion joint system in the gap to underlying structural support. Mechanical attachment may be accomplished, for example, by bolting or welding the expansion joint system to the underlying structural support.

Figure 9A:
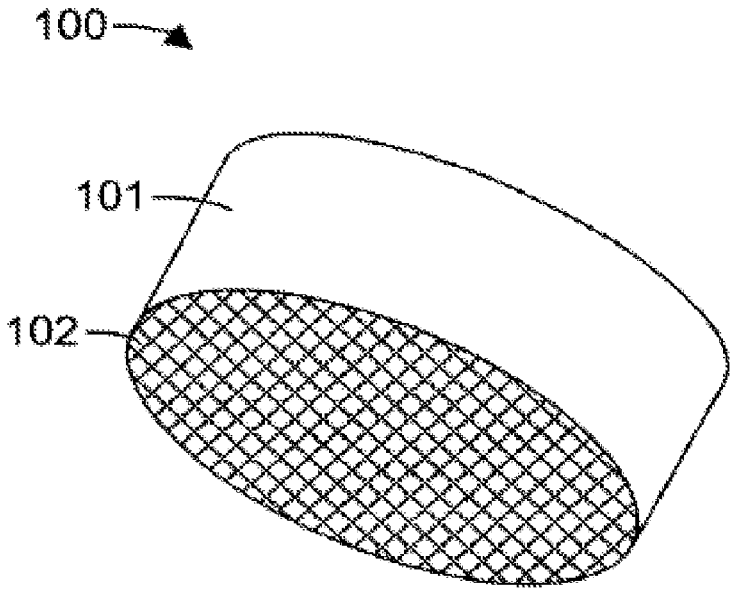
FIG. 9A is a perspective view of one illustrative embodiment of the composite sliding material.
Figure 9B:
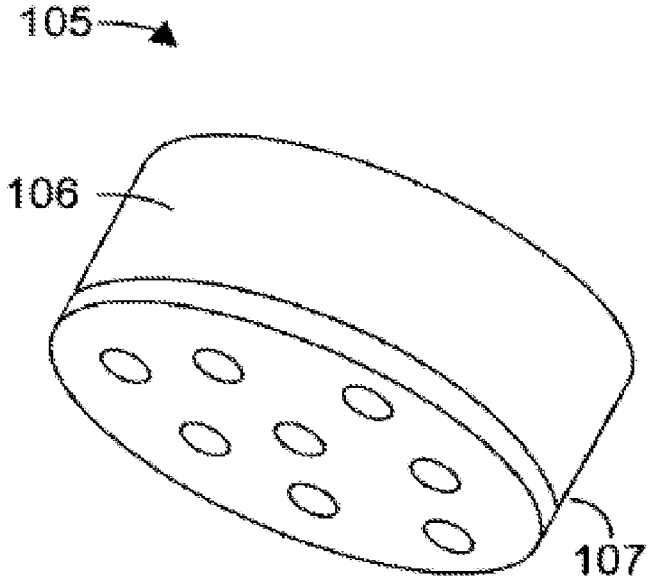
FIG. 9B is a perspective view of another illustrative embodiment of the composite sliding material.

FIG. 9A shows one illustrative embodiment of the composite sliding material 100. The composite sliding material 100 includes a substrate 101 that is interlocked with an open, plastic mesh 102. According to this embodiment, the substrate material 101 infiltrates (ie—is molded into) the open mesh 102 to create a positive interlock between the substrate 101 and the open mesh 102. FIG. 9B shows another illustrative embodiment of the composite sliding material. According to this embodiment, composite sliding material 105 includes substrate 106 and a plastic sheet layer 107 having a plurality of apertures, which is interlocked with the substrate 106. The substrate material 106 infiltrates (ie—is molded into) the openings (ie—apertures) of the sheet layer 107 to create a positive interlock between the substrate 106 and the apertured plastic sheet layer 107.

While the present invention has been described above in connection with the preferred embodiments, as shown in the various figures, it is to be understood that other similar embodiments may be used or modifications and additions may be made to the described embodiments for performing the same function of the present invention without deviating therefrom. Further, all embodiments disclosed are not necessarily in the alternative, as various embodiments of the invention may be combined to provide the desired characteristics. Variations can be made by one having ordinary skill in the art without departing from the spirit and scope of the invention. Therefore, the present invention should not be limited to any single embodiment, but rather construed in breadth and scope in accordance with the recitation of the attached claims.

We claim:

1. A bearing comprising:

a bearing substrate having top and bottom surfaces and vertically straight side walls; and an upper bearing portion bonded over at least a portion of the top surface of said bearing substrate and contacting said bearing substrate on only the top surface of said bearing substrate, the upper bearing portion having:

concavely curved side walls; and a convexly curved top bearing surface extending between said sidewalls, the top bearing surface having a flat central surface and a convex transition portion extending between the flat central surface and the side walls;

wherein the width between the sidewalls is greater than the width of the flat central surface.

2. The bearing of claim 1, wherein said flat central surface is centrally located on the curved top bearing surface.

3. The bearing of claim 1, wherein said curved side walls of said upper bearing portion are concavely curved toward the center of said upper bearing portion.

4. The bearing of claim 1, wherein said bearing substrate is substantially cylindrical.

5. The bearing of claim 1, wherein said upper bearing portion is capable of undergoing a conformational change in response to the application of a load to said bearing.

6. The bearing of claim 5, wherein said upper bearing portion is capable of undergoing a conformational change in response to the application of a maximum load to said bearing, whereby said side walls of said upper bearing portion change conformation from being concavely curved to a conformation that is substantially perpendicular to said top surface of said bearing substrate of said bearing.

7. The bearing of claim 1, wherein said substrate comprises a material selected from the group consisting of polymers, composites, and metal alloys.

8. The bearing of claim 7, wherein said composite comprises a fiber reinforced polymer.

9. The bearing of claim 7, wherein said polymer is selected from the group consisting of urethane, polytetrafluoroethylene, polyethylene, phenolic, and nylon polymers.

10. The bearing of claim 9, wherein said polymer is a phenolic polymer.

11. The bearing of claim 7, wherein said metal alloy is selected from the group consisting of bronze and steel.

12. The bearing of claim 1, wherein said upper bearing portion comprises an elastomeric material.

13. The bearing of claim 12, wherein said elastomeric material is selected from the group consisting of polyurethane, polychloroprene, isoprene, styrene butadiene rubber, and natural rubber.

14. The bearing of claim 13, wherein said elastomeric material is a urethane material.

15. An expansion joint system for roadway construction wherein a gap is defined between adjacent first and second roadway sections, said expansion joint system extending across said gap to permit vehicular traffic, said expansion joint system comprising:

transversely extending, spaced-apart, vehicular load bearing members;

elongated support members having opposite ends positioned below said transversely extending load bearing members and extending longitudinally across said expansion joint;

first means for accepting ends of said longitudinally extending elongated support members for controlling the movement of said ends of said support members within said first means for accepting longitudinally extending elongated support members;

second means for accepting opposite ends of said longitudinally extending elongated support members for controlling the movement of said opposite ends of said support members within said second means for accepting longitudinally extending elongated support members; and bearing means disposed between surfaces of said longitudinally extending elongated support members and inner surfaces of at least one of said first and second means for accepting ends of said longitudinally extending elongated support members, said bearing means comprising a bearing substrate having top and bottom surfaces and vertically straight side walls and a bottom surface and an upper bearing portion bonded over at least a portion of the top surface of said bearing substrate and contacting said bearing substrate on only the top surface of said bearing substrate, the upper bearing portion having:

concavely curved side walls; and a convexly curved top bearing surface extending between said sidewalls, the top bearing surface having a flat central surface and a convex transition portion extending between the flat central surface and the side walls;

wherein the width between the sidewalls is greater than the width of the flat central surface.

16. The expansion joint system of claim 15, wherein said flat central surface is centrally located on the curved top bearing surface.

17. The expansion joint system of claim 15, wherein said curved side walls of said upper bearing portion are concavely curved toward the center of said upper bearing portion.

18. The expansion joint system of claim 15, wherein said bearing substrate is substantially cylindrical.

19. The expansion joint system of claim 15, wherein said substrate comprises a material that substantially resists a conformational change in response to the application of a load.

20. The expansion joint system of claim 15, wherein said upper bearing portion comprises a material that is capable of undergoing a conformational change in response to the application of a load to said bearing.

21. The expansion joint systems of claim 20, wherein said upper bearing portion is capable of undergoing a conformational change in response to the application of a maximum load to said bearing, whereby said side walls of said upper bearing portion change conformation from being concavely curved to a conformation that is substantially perpendicular to said top surface of said bearing substrate of said bearing.

22. The expansion joint system of claim 15, wherein said substrate comprises a material selected from the group consisting of polymers, composites, and metal alloys.

23. The expansion joint system of claim 22, wherein said composite material comprises fiber reinforced polymers.

24. The expansion joint system of claim 22, wherein said polymer is a polymer selected from the group consisting of urethane, polytetrafluoroethylene, polyethylene, phenolic, and nylon polymers.

25. The expansion joint system of claim 24, wherein said polymer is a phenolic polymer.

26. The expansion joint system of claim 22, wherein said metal alloy is selected from the group consisting of bronze and steel.

27. The expansion joint system of claim 15, wherein said upper bearing portion comprises an elastomeric material.

28. The expansion joint system of claim 27, wherein said elastomeric material is selected from the group consisting of polyurethane, polychloroprene, isoprene, styrene butadiene rubber, and natural rubber.

29. The expansion joint system of claim 28, wherein said elastomeric material is a polyurethane material.

30. An expansion joint system for roadway construction wherein a gap is defined between adjacent first and second roadway sections, said expansion joint system extending across said gap to permit vehicular traffic, said expansion joint system comprising:

transversely extending, spaced-apart, vehicular load bearing members;

elongated support members having opposite ends positioned below said transversely extending load bearing members and extending longitudinally across said expansion joint;

means for movably engaging said longitudinally extending, elongated support members with at least one of said transversely extending, spaced-apart load bearing members; and bearing means disposed between surfaces of said longitudinally extending elongated support members and surfaces of said means for movably engaging at least one of said longitudinally extending, elongated support members with said transversely extending, spaced-apart load bearing members, said bearing means comprising a bearing substrate having top and bottom surfaces and vertically straight side walls and an upper bearing portion bonded over at least a portion of the top surface of said bearing substrate and contacting said bearing substrate on only the top surface of said bearing substrate, the upper bearing portion having:

concavely curved side walls; and a convexly curved top bearing surface extending between said sidewalls, the top bearing surface having a flat central surface and a convex transition portion extending between the flat central surface and the side walls;

wherein the width between the sidewalls is greater than the width of the flat central surface.

31. The expansion joint system of claim 30, wherein said flat central surface is centrally located on the curved top bearing surface.

32. The expansion joint system of claim 30, wherein said curved side walls of said upper bearing portion are concavely curved toward the center of said upper bearing portion.

33. The expansion joint system of claim 30, wherein said bearing substrate is substantially cylindrical.

34. The expansion joint system of claim 30, wherein said substrate comprises a material that substantially resists a conformational change in response to the application of a load.

35. The expansion joint system of claim 30, wherein said upper bearing portion comprises a material that is capable of undergoing a conformational change in response to the application of a load to said bearing.

36. The expansion joint system of claim 35, wherein said upper bearing portion is capable of undergoing a conformational change in response to the application of a maximum load to said bearing, whereby said side walls of said upper bearing portion change conformation from being concavely curved to a conformation that is substantially perpendicular to said top surface of said bearing substrate of said bearing.

37. The expansion joint system of claim 30, wherein said bearing substrate comprises a material selected from the group consisting of polymers, composites, and metal alloys.

38. The expansion joint system of claim 37, wherein said composite material comprises fiber reinforced polymers.

39. The expansion joint system of claim 37, wherein said polymer is selected from the group consisting of urethane, polytetrafluoroethylene, polyethylene, phenolic, and nylon polymers.

40. The expansion joint system of claim 39, wherein said polymer is a phenolic polymer.

41. The expansion joint system of claim 37, wherein said metal alloy is selected from the group consisting of bronze and steel.

42. The expansion joint system of claim 30, wherein said upper bearing portion comprises an elastomeric material.

43. The expansion joint system of claim 42, wherein said elastomeric material is selected from the group consisting of polyurethane, polychloroprene, isoprene, styrene butadiene rubber, and natural rubber.

44. The expansion joint system of claim 43, wherein said elastomeric material is a polyurethane material.

* * * * *